United States Patent [19]

Mueller et al.

[11] 4,301,577

[45] Nov. 24, 1981

[54] PROCESS FOR TREATING TUFTED PILE FABRIC

[75] Inventors: Helmut C. Mueller, Mauldin; Harry G. Gallagher, Taylors, both of S.C.

[73] Assignee: Bigelow-Sanford, Inc., Greenville, S.C.

[21] Appl. No.: 71,059

[22] Filed: Aug. 30, 1979

[51] Int. Cl.[3] ..... D06C 7/00; D06C 29/00

[52] U.S. Cl. ..... 26/2 R

[58] Field of Search ..... 26/2 R; 28/159

[56] References Cited

U.S. PATENT DOCUMENTS

| | | | |
|---|---|---|---|
| 2,170,968 | 8/1939 | Gentle | 26/2 R |
| 2,338,792 | 1/1944 | Whitehead | 26/2 R X |
| 2,970,362 | 2/1961 | Rankin et al. | 26/2 R |
| 3,644,954 | 2/1972 | LeGrand | 26/2 R UX |

FOREIGN PATENT DOCUMENTS

| | | | |
|---|---|---|---|
| 745070 | 10/1966 | Canada | 26/2 R |
| 999105 | 10/1951 | France | 26/2 R |
| 50-26676 | 9/1975 | Japan | 26/2 R |

*Primary Examiner*—Robert Mackey

*Attorney, Agent, or Firm*—Burgess, Ryan and Wayne

[57] ABSTRACT

A process for erecting the pile and increasing the yarn bulk of dyed or printed carpeting which has been bent, matted and crushed during processing. The carpeting is heated in a steam chamber to a temperature above the highest processing temperature and in the range of 170°-212° F., to override the yarn memory. A beater bar within the steam chamber then beats the carpet to reduce the bending, matting and crushing of the pile.

1 Claim, 1 Drawing Figure

PROCESS FOR TREATING TUFTED PILE FABRIC

Figure 1:
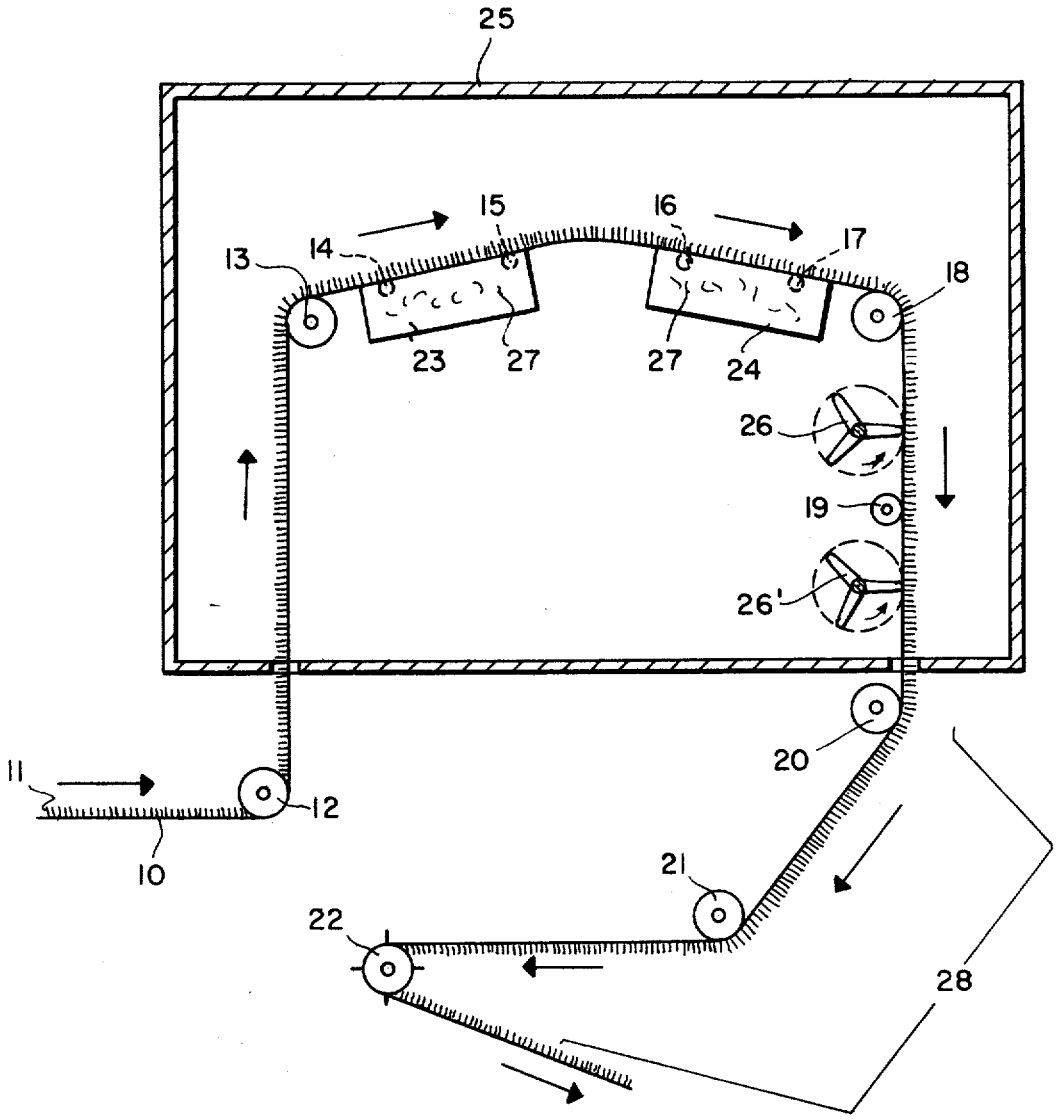

This invention relates to a process for treating a tufted pile fabric, including but not limited to carpeting.

The present invention is directed to the application of steaming and beating techniques (which have been applied to carpets, to improve surface appearance, for many years) to the alleviation of a processing defect that has been inherent and most difficult to correct, particularly in tufted plushes, cut/loop and zig-zag styles. It is particularly prevalent in fabrics having pile yarns of synthetic fibers. It also occurs, but to a lesser extent, in tufted loop pile styles and in woven carpet.

Changes in dyeing and finishing procedures and apparatus, introduced in recent years, have increased the prevalence and severity of this defect. The defect is a bending, matting and crushing of the pile tufts. This is imposed on the fabric pile by the various rolls, particularly squeeze rolls used in the dyeing, rinsing, drying, etc. cycles. This bending, matting and crushing, to a large degree, remains in the finished fabric.

Most dyeing and/or printing of pile yarns and pile fabrics is now done at high speeds and usually as a continuous process. In the past, the dyeing and/or printing and subsequent processes were done at lower speeds and usually not in a continuous process flow, but in step by step cycles. Further, most dyeing is now done at temperatures that can be considered as cold when compared to past dyeing that was done at or near the boil.

The lower speeds and higher temperatures of past procedures resulted in considerable agitation being imparted to the fabric and pile yarns and the yarn was opened or bulked to a considerable extent during the long dyeing and finishing cycle. The high speeds and lower temperatures of the present day procedures impart little or no agitation to the pile fabric and pile yarn is given little bulk or opening. As a result, the bending, matting and crushing imparted during the processing remains, is not removed to the desired extent, and shows up as a defect in the finished carpet.

Accordingly, an object of the present invention is to provide an improved process for erecting the pile and increasing the bulk of pile fabrics which have been subjected to bending, matting, and crushing as described above.

As herein described there is provided, in a process for dyeing or printing a tufted pile fabric, wherein said fabric is heated to a predetermined maximum temperature and passed over various rolls, resulting in bending, matting and crushing of the fabric pile, the improvement comprising the steps of subsequently heating said fabric to a yarn memory overriding temperature above said predetermined temperature and in the range of 170° F. to 212° F., and thereafter beating the heated fabric while said fabric is within 20° F. of said memory overriding temperature, thereby erecting said pile and increasing the bulk thereof.

IN THE DRAWING

FIG. 1 is a diagram illustrating the movement of pile fabric through the apparatus utilized for carrying out the improved process of the present invention.

With today's high speed continuous dyeing and/or printing equipment for pile fabrics such as carpeting, little or nothing is being done to develop maximum bulk of the pile yarn. The dyes are applied cold and then steam-fixed. In many cases, depending on dye application, the carpet enters the steam chamber with considerable pile distortion (matted down), which distortion is "heat-set" at around 212° F. After dye fixation, the carpet usually goes through a cold or warm rinse and is dried and rolled up. The resulting finished carpet lacks bulk (hand), and shows considerable pile-lay induced during various stages of the finishing process.

The present invention provides a simple and reliable method to bulk and erect the pile-yarn at the same time. Prior to backcoating, the carpet is heated in an enclosed steam chamber to a yarn memory overriding temperature above the highest temperature used during prior finishing processes. After reaching this memory overriding temperature, the carpet is subjected to beating by means of one or more backbeaters located in the steam chamber. Since the pile yarn is hot and pliable at the time of beating, the pile is fluffed (bulked), and snapped-up (erected). The carpet is cooled prior to making contact with any face-rolls.

As shown in FIG. 1, a continuous length of carpet 10 which has been dyed or printed in a process resulting in bending, matting and crushing of the fabric pile 11, is guided over a series of rollers 12–22. These rollers guide the carpet through a steam chamber 25 in which are disposed horizontally oriented steam boxes 23 and 24, and three-bar beaters 26 and 26'. The steam boxes 23 and 24 have the openings thereof upwardly oriented, so as direct steam in an upward direction through the back of the carpet and out through the pile face thereof. Guide rollers 14 and 15 within the steam box 23, and rollers 16 and 17 within the steam box 24, prevent the carpet from contacting the edge of the steam box.

A three-bar beater 26 is disposed within the steam chamber 25 between the rollers 18 and 19 downstream of the steam boxes 23 and 24; and another three-bar beater 26'' is disposed within the steam chamber 25 between the rollers 19 and 20 downstream of the beater 26.

After leaving the steam chamber 25, the carpeting 10 traverses a cooling zone 28 between the steam chamber 25 and fluted roll 22.

The speed of movement of the carpeting 10 through the arrangement of FIG. 1 is typically in the range of 25 to 50 feet per minute, and preferably on the order of 35 feet per minute. However, if the length of the steam chamber 25 and the cooling zone 28 are increased, the speed of movement of the carpeting 10 may be similarly increased.

The length of the cooling zone 28, the temperature to which the carpet is heated in the steam chamber 25, and the speed of movement of the carpet are such that by the time the carpet reaches the fluted roll 22, its temperature has decreased to below 110° F.

The steam boxes 23 and 24 are filled with steam 27 which is directed against the backing of the carpeting 10 (by means not shown in the drawing), to heat the carpeting 10 to a temperature in the range of 170° F. to 212° F. and higher than the maximum temperature at which the carpeting was processed during previous dyeing or printing operations. Preferably, the temperature to which the steam chamber 25 heats the carpeting 10 is in the range of 170° F. to 190° F., and it is this temperature at which the carpet is beat by the three-bar beaters 26 and 26' within the steam chamber 25.

Optimum bulk and pile erection are realized when the steam flows directly from the steam box up through the back of the fabric and out of the face of the fabric. Air entrapped in the pile depths can increase the time required to raise the temperature within the pile to the required temperature. Directly impingeing the steam onto the back of the fabric provides a means that insures the immediate displacement of the entrapped air.

Alternatively, one or both of the beaters 26 and 26' may be situated outside and downstream of the steam chamber 25, provided that the temperature of the carpet when it reaches the beater(s) has not decreased more than 20 degrees from the temperature to which the carpet is heated by the steam chamber 25. Preferably, the carpeting 10 should be at a temperature in the range of 170° F. to 190° F. at the time it is beaten by the beater(s) 26 and/or 26'.

The beaters 26 and 26' may each typically subject the carpeting 10 to 400–1000 beats per minute. In a typical processing setup, the three-bar beaters 26 and 26' are rotated at 283 rpm, imparting about 850 impacts per minute to the carpeting 10. The beater-carpet interference, i.e. the distance by which the beaters 26 and 26' deflect the carpeting 10 from its path of movement, may be in the range of 1 to 3 inches, with a 2 inch deflection being preferred.

Beaters having less or more than three bars may be employed if desired, and more than two beaters may be employed as well.

We claim:

1. In a process for dyeing a tufted pile fabric, wherein said fabric is heated to a predetermined maximum temperature and passed over various rolls, resulting in bending, matting and crushing of the fabric pile, the improvement comprising the steps of:

subsequently heating said fabric within a chamber to a yarn memory overriding temperature above said predetermined temperature and in the range of 170° F. to 212° F., by directing steam through the back of the fabric and out the pile face thereof;

thereafter subjecting the heated fabric to a plurality of heating steps while said fabric is within said chamber and within 20° F. of said memory overriding temperature and at a temperature in the range of 170° F. to 190° F., said fabric being (i) subjected to 400–1,000 beats per minute and (ii) deflected a distance in the range of 1 to 3 inches during each said beating step, said beating steps being carried out along a vertical path of travel of said fabric, thereby erecting said pile and increasing the bulk thereof; and after said beating steps cooling said fabric to a temperature below 110° F. before said fabric contacts any downstream processing rolls, wherein said fabric is linearly moved along a path thereof at a speed in the range of 25 to 50 feet per minute during said subsequent heating and beating steps.

* * * * *